US005174477A

United States Patent [19]

Schafer

[11] Patent Number: 5,174,477

[45] Date of Patent: Dec. 29, 1992

[54] WATER SQUIRT TOY

[76] Inventor: Joel M. Schafer, 2014 Huntington La., Redondo Beach, Calif. 90278

[21] Appl. No.: 669,118

[22] Filed: Mar. 12, 1991

[51] Int. Cl.[5] ..... B65D 37/00

[52] U.S. Cl. ..... 222/183; 222/212; 222/78; 141/18; 141/26; 251/10; 446/475

[58] Field of Search ..... 222/79, 78, 183, 212, 222/211, 215; 141/18, 26, 25, 114; 446/475, 473, 186, 187; 251/7-10

[56] References Cited

U.S. PATENT DOCUMENTS

| | | | |
|---|---|---|---|
| 3,351,105 | 11/1967 | Di Perna | 141/18 |
| 3,412,906 | 11/1968 | Dinger | 222/183 X |
| 3,848,808 | 11/1974 | Fetty et al. | 222/183 X |
| 4,097,020 | 6/1978 | Sussman | 251/10 |
| 4,135,559 | 1/1979 | Barnby | 141/18 |
| 4,225,254 | 9/1980 | Holberg et al. | 141/18 X |
| 4,257,460 | 3/1981 | Paranay et al. | 141/26 |
| 4,735,239 | 4/1988 | Salmon et al. | 222/213 X |
| 4,854,480 | 8/1989 | Shindo | 222/183 X |
| 4,867,208 | 9/1989 | Fitzgerald et al. | 141/18 |
| 5,064,095 | 11/1991 | Camerino | 222/212 X |

OTHER PUBLICATIONS

Photograph of a constant pressure water squirt toy designed and built by applicant.

Water Whomper product brochure; Aqua Sling Co., P.O. Box 20404, San Diego, CA 92120.

Photograph of packaging display for Water Weenie product, Playtel Toy Co., Boise, Idaho 83704.

*Primary Examiner*—Andres Kashnikow
*Assistant Examiner*—Kenneth DeRosa
*Attorney, Agent, or Firm*—Stetina and Brunda

[57] ABSTRACT

The water squirt toy of the invention comprises a length of elastic tubing having a nozzle positioned on one end and a clip, climp or staple crimped about the other end. A pliable tubular sleeve may be positioned about the elastic tubing for purposes of safety and protection. Such pliable sleeve may be attached at one end of the tubing by the same clip clamp or staple which is utilized to clamp off the axial bore of the tubing at that end thereof. The nozzle may comprise any type of squirt nozzle including small tubular inserts or the bottom portion of a ball point pen barrel.

14 Claims, 5 Drawing Sheets

FIG. 9
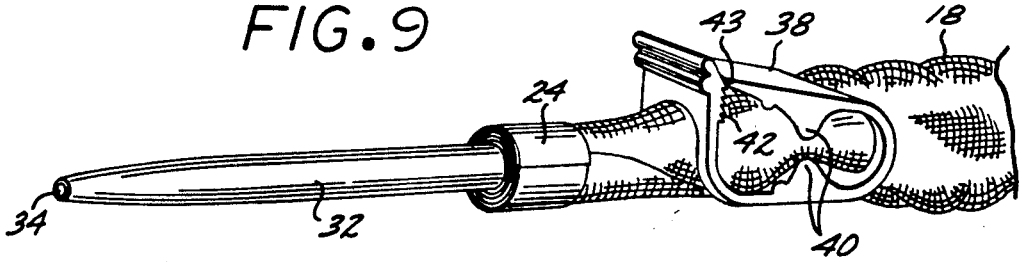
FIG. 10
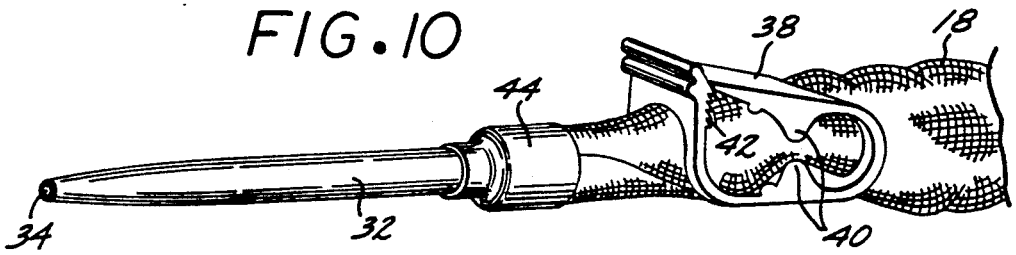
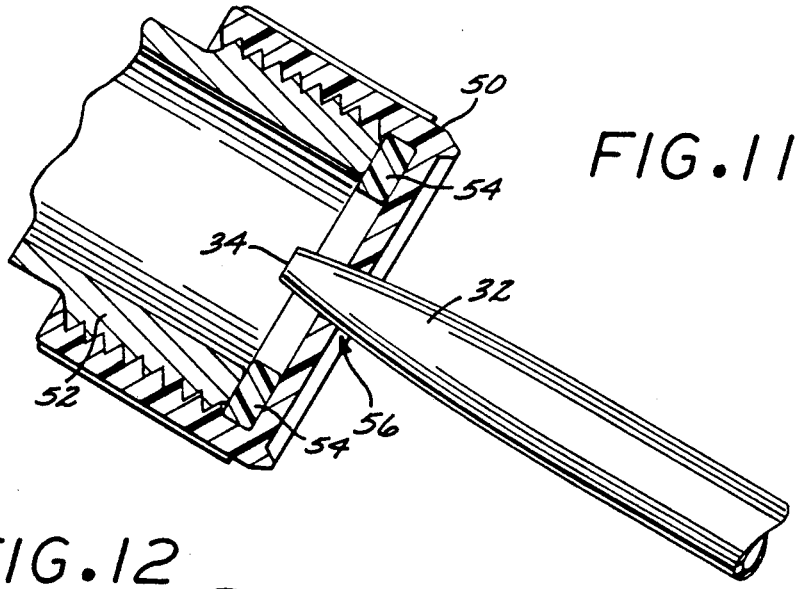
FIG. 11
FIG. 12
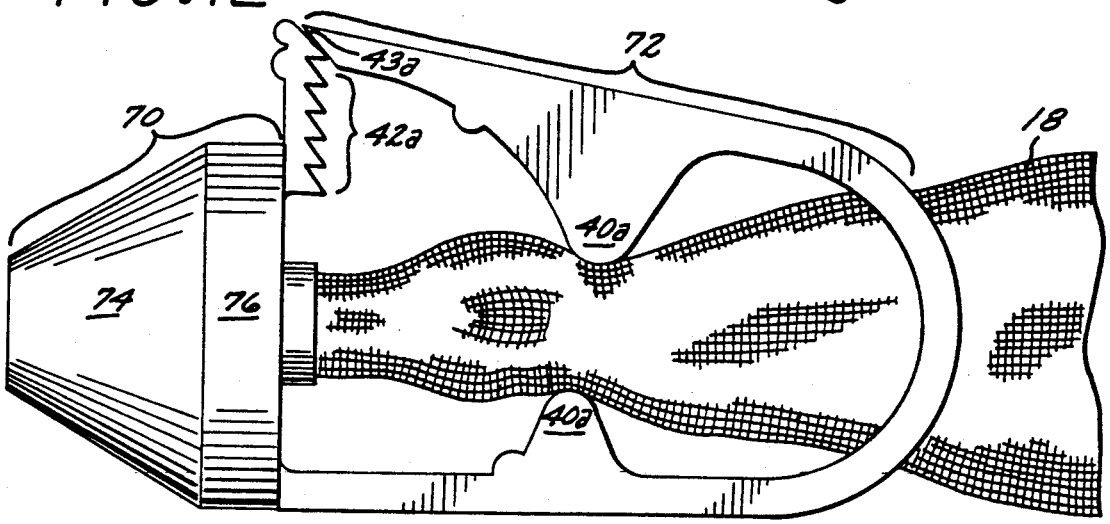

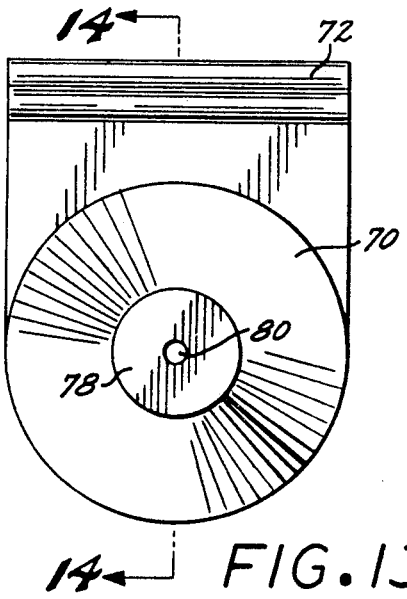
FIG. 13
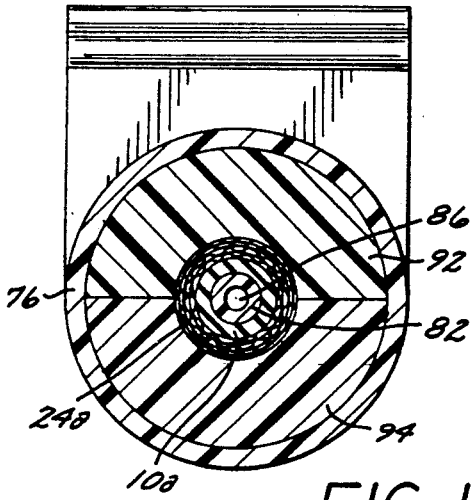
FIG. 15
FIG. 14
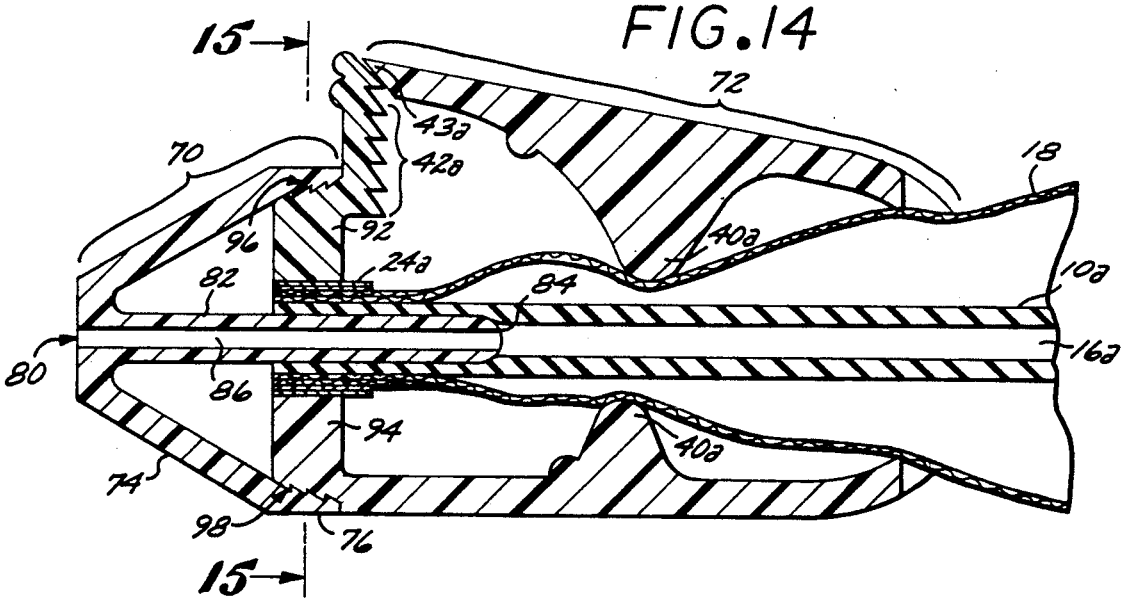
FIG. 16
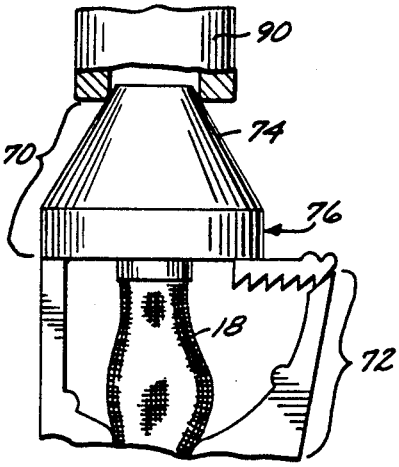

WATER SQUIRT TOY

FIELD OF THE INVENTION

The present invention pertains generally to the art of toys and recreational devices and more particularly to a water squirt toy.

BACKGROUND OF THE INVENTION

Various types of squirt guns have been well known in the prior art. Conventional squirt guns of the prior art typically consist of a hollow, gun shaped body incorporating hand operable pump whereby the user may repeatedly pump the trigger so as to cause intermittent expulsion or spurting of water through the barrel of the gun.

More recently, constant pressure squirt toys have become known in the art. Such constant pressure squirt toys generally comprise a resilient or elastic tube (e.g. a section of latex tubing) which may be force filled with water causing the tube to expand, thus pressurizing the water contained therein. A valve and nozzle arrangement is connected to the tube. When the valve is opened, a substantially constant stream of water is expelled outwardly through the nozzle. When the valve is once again closed, the outflow of water stops. These constant pressure types of squirt toys rely upon the resiliency or elasticity of the tube for expelling the water. Thus, such constant pressure squirt toys do not require the inclusion of a pump device for manually pumping the water as in the "squirt gun" type toys of the prior art.

Some constant pressure squirt toys have heretofore been known to present certain dangers to children or adults using such devices. For example, at least one of the early models of constant pressure squirt toys comprised an uncovered latex tube which, in the event of a blow out or rupture, could result in injury due to the rapid outflow of pressurized water and/or fragments of assembly components or the ruptured latex tube. In an effort to prevent such injuries, manufacturers of some prior art water squirt toys have included a knit tubular sleeve positioned around the exterior of the latex tube. The provision of such exterior sleeve is known to serve three (3) injury preventing functions. First, the exterior sleeve helps to protect the latex tube from abrasion or damage. Second the sleeve if properly sized, may confine and prevent over-expansion of the latex tube. Third, the sleeve helps to dampen the outflow of water and fragments of the latex tube and associated components in the event of undesirable rupture of the tube.

Although the provision of the knit outer sleeve has helped to minimize the likelihood of injuries resulting from frank rupture of the latex tube, there have nonetheless, remained other potentially dangerous aspects of the construction of the prior art constant pressure squirt toys.

For example, at least one prior art device incorporates a small plastic or wooden plug inserted and/or glued into the rear end of the expandable latex tube. The plugged end of the tube remains substantially uncovered, thus presenting an injury hazard in the event that if the end plug should blow out of the tubing in such a manner as to become a projectile.

In addition to the above-described injury hazards, the other aspects of the design and construction of the prior art devices are also known to be less than optimal. For instance, the insertion/connection of the water squirting nozzle to the expandable elastic tube has heretofore been accomplished by relatively simple means such as partially inserting a rigid tubular nozzle member into the front end of the tube and, thereafter, securing that end of the tube, to the inserted portion of the nozzle with adhesive and/or tie-wraps. Such construction has been known to result in loosening of the nozzle upon repetitive or rough usage and when such loosening occurs, may result in complete separation of the nozzle from the tube.

Also the prior art constant pressure squirt toys generally require the use of a separate water faucet connector/adaptor when filling the device from a standard water faucet. Such adaptors are likely to become lost and, also, as specifically sized so as to fit only one type of water faucet (e.g. an externally threaded ¾" outdoor spigot) thereby precluding the use of other sizes and types of faucets when filling the device.

Accordingly, there exists a need in the art for an improved constant pressure water toy which eliminates the likelihood of injury due to explosion and/or end plug blow out and which is assembled and constructed in such manner as to maximize wear resistance and field reliability. Additionally, there exists a need in the art for a constant pressure water squirt toy which may be filled by a variety of sizes and types of water outlets without the need for a separate faucet outlet or adaptor.

SUMMARY OF THE INVENTION

The present invention overcomes some or all of the shortcomings of the prior art through the provision of an improved water squirting toy and a method of manufacturing same.

In accordance with the invention, there is provided a water squirt toy comprising: an elastic tube having a front end, a rear end and an axial bore extending longitudinally therethrough; a nozzle positioned on the front end of said elastic tube and a clip, clamp or staple crimped about the rear end of said elastic tube so as to compressively close off the rear end of the hollow bore of said elastic tube.

Further in accordance with the invention, a pliable sleeve such as a cylindrical tube of knit or woven fabric may be disposed about the elastic tube. The front end of the sleeve is affixed at or near the front end of the elastic tube and the rear end of the sleeve is affixed at or near the rear end of the elastic tube. In a preferred embodiment, a single metal clip, clamp or staple is positioned over both the rear end of the sleeve and the rear end of the elastic tube so as to concomitantly (a) attach the sleeve to the rear end of the plastic tube and (b) compressively seal off the rear end of the hollow bore of the elastic tube. Thus, in the preferred embodiment, the clip, clamp or staple serves the dual function of affixing the outer sleeve to the rear end of the elastic tube and also forming a fluid tight seal at the rear end of the elastic tube without the need for a separate plug, cap or other member for sealing off the hollow bore.

Still further in accordance with the invention, the nozzle attached to the front end of the elastic tube may comprise a simple tubular device such as the lower portion of a ball point pen barrel. A quantity of glue or adhesive may be applied to the front end of the elastic tube prior to insertion of a portion of the nozzle thereinto. Such glue or adhesive will subsequently serve to adhere and hold the nozzle in its operative inserted position within the front end of the elastic bore. Additionally, such glue or adhesive may provide additional lubricity to assist the manufacture and inserting the nozzle into the bore of the elastic tube.

Even further in accordance with the invention, there is provided an improved conical or frusto conical nozzle for mounting on various types of water squirt toys, including those of the foregoing character. Such nozzle is provided with a conical or frusto conical outer surface which may be partially inserted into water faucets of varying size and configuration, thereby permitting the squirt toy to be filled from various types of water faucets without the need for any separate screw on adaptor cap or other filling appliance.

Further aspects of the invention will become obvious to those skilled in the art upon reading and understanding the following detailed description and the accompanying drawings.

BRIEF DESCRIPTION OF THE DRAWINGS

FIG. 9 is a perspective view of a portion of a preferred water squirt device of the present invention during a ninth step in the manufacture thereof;

FIG. 10 is a perspective view of a portion of a preferred water squirt device of the present invention during a tenth step in the manufacture thereof;

FIG. 11 is a side cross sectional view of a water outlet having an adaptor for filling the water squirt device of the present invention disposed thereon, and further, having a portion of the nozzle tip of a preferred water squirt device of the present invention inserted therein;

FIG. 12 is a side elevational view of an alternate nozzle and clamp design disposed on the front end of a water squirt device of the present invention;

FIG. 13 is a front view of the alternative nozzle and clamp device of FIG. 12;

FIG. 14 is a cross sectional view through line 14—14 of FIG. 13;

FIG. 15 is a cross sectional view through line 15—15 of FIG. 14;

FIG. 16 is a side view of a standard water faucet having the conical tip of the alternate nozzle and clip of the present invention operatively inserted therein for filling of the water squirt device.

DETAILED DESCRIPTION OF THE PREFERRED EMBODIMENT

The following detailed descriptions and the accompanying drawings are provided for purposes of illustrating and describing certain presently preferred embodiments of the invention, and are not intended to limit the scope of the invention, or the following claims, in any way.

i. Structure, Function and Manufacture of the Embodiment Shown in FIGS. 1-11

The embodiment shown in FIGS. 1-11 is a complete water squirting toy/device constructed and configured in accordance with the present invention.

Figure 1:
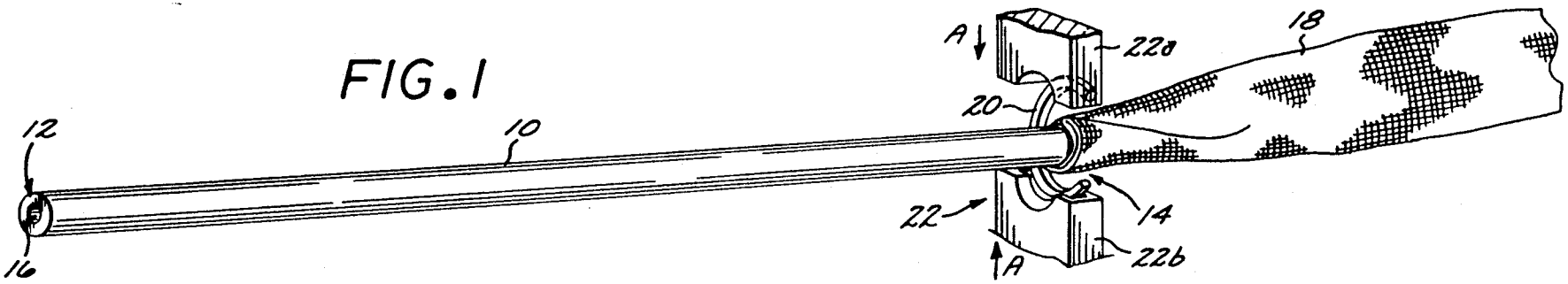
FIG. 1 is a perspective view of a portion of a preferred water squirt device of the present invention during a first step in the manufacture thereof.
Figure 3:
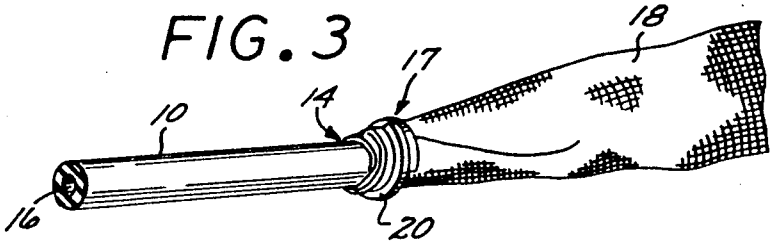
FIG. 3 is a perspective view of a portion of a preferred water squirt device of the present invention during a third step in the manufacture thereof.

FIGS. 1-10 depict various stages in the manufacture of a presently preferred water squirt device of the present invention. As shown in FIG. 1, the embodiment depicted therein comprises an elongate section of latex tubing 10 (Prime Line Industries, Cuyahoga Falls, Ohio). Such section of latex tubing 10 may be any desired length. Generally it is desirable for the section of tubing 10 to be between six (6) inches and forty (40) inches in length. In the preferred embodiment shown the tubing 10 is about twelve inches in length. Such section latex tubing 10 is preferably about $\frac{3}{8}$ to $\frac{1}{2}$ inch in outer diameter, however, other diameters of elastic tubing may also be used. The particular latex tubing used in the presently preferred embodiment has an outer diameter (od) of about $\frac{3}{8}$ inch and an inner diameter (id) of about 3/16 inch.

The section of latex tubing 10 has a front end 12, a rear end 14, and a hollow axial bore 16 extending longitudinally therethrough.

A polyester tubular knit sleeve 18 is initially positioned next to the tube 10, in the manner shown in FIG. 1, such that the rear end 14 of the tube 10 is slightly inserted into one end 17 of the sleeve 18. The end 17 of the sleeve 18 into which the rear end 14 of the tube 10 has been inserted is then compressed, pleated, wrapped or folded snugly about the outer surface of the rear end portion of tube 10. A clip 20 is thereafter, compressively crimped around the compressed, pleated, wrapped or folded portion of the sleeve 18 as well as the underlying portion of tube 10 which resides within the end 17 of sleeve 18. The clip 20 may be formed of any suitable material including metal or formable plastic. An example of a clip which has been found to be particularly suitable for use in this preferred embodiment is a standard metal "sausage clip" used to clip the ends of plastic meat wrappers and or sausage casings. (Poly-Clip Niedecker Corp, GMBH).

Figure 2:
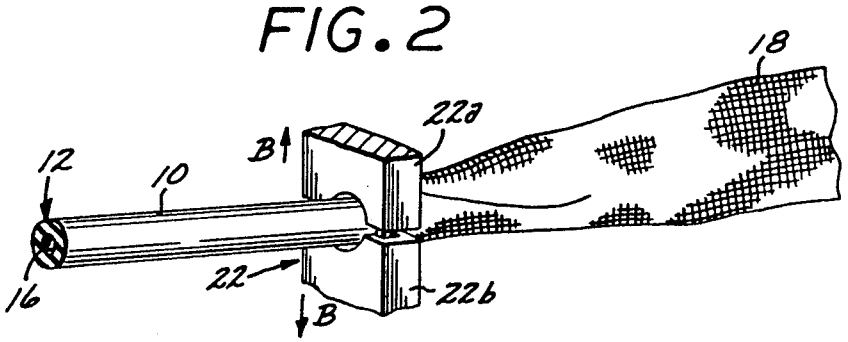
FIG. 2 is a perspective view of a portion of a preferred water squirt device of the present invention during a second step in the manufacture thereof.

The clip 20 may be compressively crimped in any manner, using any suitable force exerting instrument. For example, as shown in FIGS. 1 and 2, a crimping die or device 22 may be compressed about the clip 20 to effect the desired crimping of the clip 20. Such crimping die or device 22 comprises an upper member 22*a* and a lower member 22*b*. The upper 22*a* and lower members 22*b* of the crimping die 22 are closed inwardly (arrows A) around clip 20 until the members 22*b*, 22*c* have reached their fully closed positions as shown in FIG. 2. This exerts sufficient pressure on clip 20 to tightly crimp clip 20 around the sleeve 18 and tube 10, attaching the end 17 of sleeve 18 to tube 10 and further causing the longitudinal bore of tube 10 to the completely pinched off and closed. Thereafter, the upper member 22*a* and lower member 22*b* of the crimping die 22 are opened or separated (arrows B) and the tubing 10, clip 20, and sleeve 18 are removed therefrom. By the above-described clipping of the sleeve 18 and underlying tube 10, the rear end 14 of the tube 10 becomes tightly sealed without the need for insertion or disposition of an internal plug or stopper within the rear end 14 of the axial bore 16 of tube 10. Additionally, the clip 20 serves to firmly attach and connect the sleeve to the rear end 14 of the tube.

Figure 4:
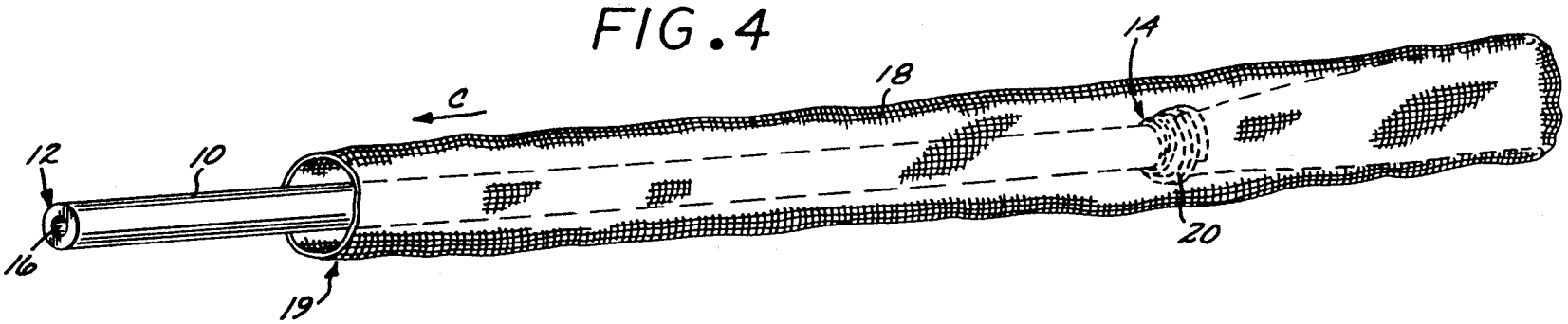
FIG. 4 is a perspective view of a portion of a preferred water squirt device of the present invention during a fourth step in the manufacture thereof.
Figure 5:
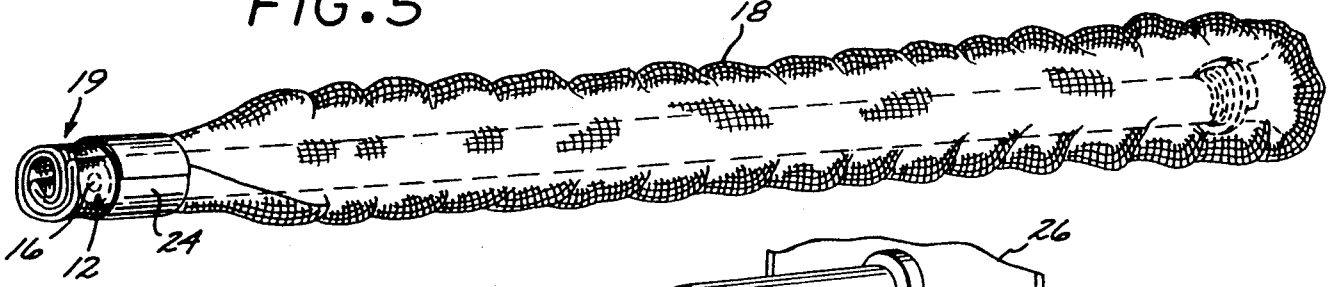
FIG. 5 is a perspective view of a portion of a preferred water squirt device of the present invention during a fifth step in the manufacture thereof.
Figure 6:
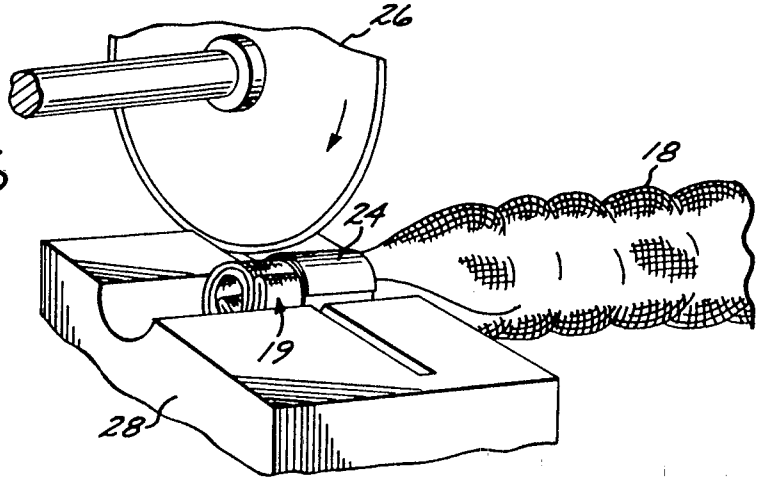
FIG. 6 is a perspective view of a portion of a preferred water squirt device of the present invention during a sixth step in the manufacture thereof.
Figure 8:
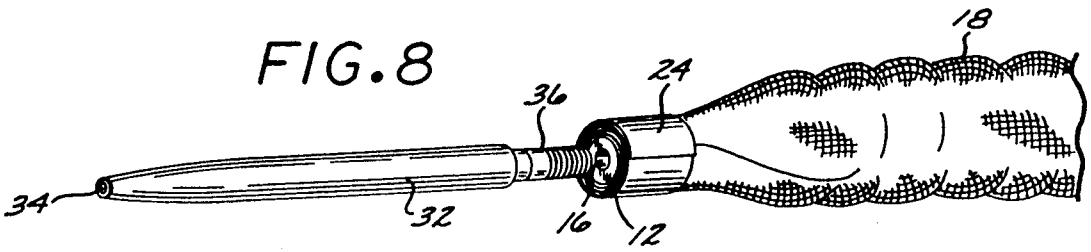
FIG. 8 is a perspective view of a portion of a preferred water squirt device of the present invention during an eighth step in the manufacture thereof.
Figure 7:
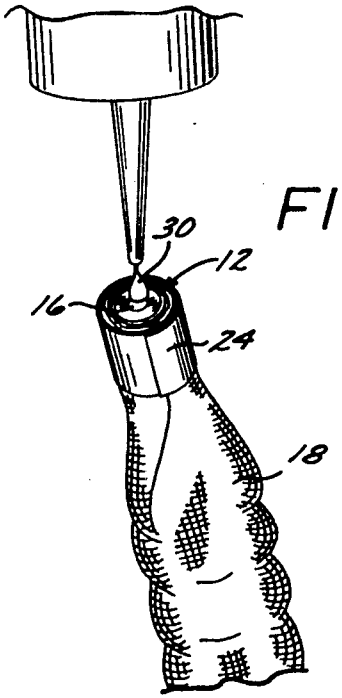
FIG. 7 is a perspective view of a portion of a preferred water squirt device of the present invention during a seventh step in the manufacture thereof.

After the clip 20 has been crimped around the sleeve 18 and rear end 14 of tube 10, the sleeve 18 is inverted over itself and pulled longitudinally (arrow C) over the outer surface of tube 10, as shown in FIG. 4. thereafter, end 19 of sleeve 18 is compressed, pleated, wrapped or folded about the front portion of the tube 10 such that a small amount (e.g. one-quarter inch) of the sleeve 18 material extends beyond the front end 12 of the tube 10 (See FIG. 5).

A suitable type of wrapping o binding material such as wire, string, cord or tape 24 is securely wrapped about the compressed, pleated, wrapped or folded portion of the sleeve 18 whereat the sleeve 18 overlays the front end 16 of the tube 10. In some applications it is desirable to use a wrapping material or tape 24 which is slightly stretchable or elastic material (e.g. plastic electrical tape) so as to permit a slight degree of radial expansion during subsequent steps of this manufacturing process wherein a tube like nozzle 32 is inserted into the axial bore 16 at the front end 12 of tube 10.

A cutting device is employed to cut the distal end 19 of the sleeve 18 and surrounding tape flush with the distal end 16 of the tube 10. Preferably, a slight portion of the frontal tip 16 of tube 10 is severed or cut away, along with the excess overhanging portion of the distal end 19 of sleeve 18. In the method shown, the cutting device comprises a placement jig 28 with an attendant rotary cutting wheel 26. It will be appreciated, however, that many other suitable types of cutting device may be employed, including simple scissors, knives, etc.

A clamping apparatus such as clamp 38 is advanced onto the device. Such clamping apparatus may comprise any type of clamp or other apparatus operable to permit the user of the device to selectively clamp or pinch off the inner bore 16 of the tube 10 in such manner as to effectively control (i.e. on/off) the outflow of water through the distal opening 34 of nozzle 32. In the embodiment shown, the clamp 38 comprises a one piece plastic body which is alternately disposable in an "open" configuration and a "closed" configuration. In its "open" configuration, the internal projections 40 of the clamp 38 are sufficiently far apart to permit the axial bore 16 of the underlying tube 10 to remain patent and open thereby permitting the free outflow of water through the distal opening 34 of the nozzle 32. When, however, at least the upper portion of the clamp 38 is pinched or compressed downwardly, the inward projections 40 of the clamp 38 will come together, thereby clamping off the axial inner bore of the underlying tube 10, serving to close off or prevent further outflow of water through the distal end opening 34 of nozzle 32. The pawl like upper portion 43 of the clamp 38 will interact with the ratchet surface 42*a* to lock and hold the clamp 38 in such "closed" configuration. When it is desired to once again open the clamp 38, the user may hand manipulate the clamp so as to disengage the pawl like head 43*a* from the ratchet surface 42*a*, allowing the clamp 38 to return to its above-described "open" configuration. By this arrangement, the clamp 38 permits the user to collectively and periodically squirt water out of the open end 34 of nozzle 32. After the distal end 19 of the sleeve 18 and surrounding tape 24 have been cut flush with the distal end 16 of the tube 10, a quantity of glue or adhesive 30 is dispensed into the bore 16 at the front end 12 of tube 10. The glue or adhesive 30 may comprise any type of glue or adhesive material capable of bonding or holding a selected nozzle, or portion thereof, within the, axial bore 16 of the tube 10. In the embodiment shown, it is preferable that the glue or adhesive 30 be a viscous liquid or gelatinous material capable of initially imparting some lubricity to the surface of the inner bore 16 of the latex tube 10, thereby facilitating subsequent insertion of a tubular nozzle 32 into the axial bore 16 of the tube 10. Liquid cyanoacrylate glue (e.g. Krazy Glue TM ) has been found to impart desirable lubricity when first applied and subsequently when dry or cured, to form an acceptable bond between the nozzle 32 and the tube 10.

After the glue or adhesive 30 has been dispensed into the bore 16 at the front end 12 of tube 10, the substantially rigid nozzle 32 is inserted into the bore 16 at the front end 12 of tube 10. In the embodiment shown (FIG. 8) the nozzle 32 comprises the hollow lower portion of a ball point pen barrel. The nozzle 32 has a distal tip opening 34 and a narrowed threaded proximal portion 36. The proximal portion 36 is inserted into the bore 16 at the distal end 12 of tube 10 while the glue or adhesive 30 is still wet or gelatinous. Thereafter, the glue or adhesive is permitted to dry, cure or set. The use of stretchable or expandable tape 24 permits such insertion of the distal end 36 of nozzle 32 into the bore 16 without tearing or rupturing the tape 24. Thereafter the tape 24 continues to exert inward pressure or the threaded portion 36 of the nozzle 32 helping to hold the nozzle 32 in place within the bore 16 of tube 10 and at the same time, securely affixing the front end 19 of sleeve 18 to the outer surface of the front end 12 of tube 10.

After the nozzle 32 has been inserted into the bore 16 of the distal end 12 of tube 10 and the glue or adhesive 30 has dried, set or polymerized.

After the nozzle 32 has been inserted into the tube 10, a cover 44 is advanced over nozzle 32 to a position whereby it resides upon the distal portion of the sleeve 18 and tape 24 as well as an adjacent portion of nozzle 32. In the embodiment shown, the cover 44 comprises a pliable or rigid member having an upper cylindrical portion of a first diameter and a lower cylindrical portion of a second diameter, smaller than the diameter of said upper cylindrical portion. By such configuration, the cover 44 fits snugly about the proximal portion of the nozzle 32 as well as the distal portion of the sleeve 18 and tape 24. The cover member 44 may be made of any suitable material and, in the embodiment shown, is preferably made of pliable material, such as dip molded vinyl, which is sufficiently elastic, and appropriately sized, to hold snugly in the position shown in FIG. 10.

The cover may, however, be made of any suitable material or mode of construction. The cover 44 may also be constructed so as to limit expansion of the tube so as to help to hold the nozzle 32 with the tube.

ii. Operation of the Embodiment Shown in FIGS. 1-11

The embodiment shown in FIG. 1-11 includes a separate filling adaptor 50. This separate filling adaptor 50 comprises an internally threaded cap which may be rotatably advanced onto the thread 52 of an outdoor water faucet. A washer 54 is positioned within the interior of the adaptor 50 so as to prevent leakage of water around the edges of the adaptor 50. A single hole or aperture 56 is formed in the frontal portion of the adaptor 50. The hole or aperture 56 is sized to permit insertion of a portion of the nozzle 32 to a point where the outer surface of the nozzle 32 frictionally engages the adaptor 50 forming a generally fluid tight seal therebetween. Following such insertion of the nozzle 32 into adaptor 56, the clamp 38 is opened and the water faucet is turned on, thereby permitting the inflow of pressurized water through end opening 34 of nozzle 32 and into tube 10, so as to expand and fill the tube 10. After tube 10 has been expanded and filled to a desired level, the clamp 38 is compressed to its closed configuration and the nozzle 32 extracted from the fill adaptor 50.

When the embodiment shown in FIGS. 1-11 has been filled with water in the above-described fashion, the expandable latex tube 10 will have been expanded to a point where it is approximately 1-2 feet in length and about $\frac{1}{2}$ to $1\frac{5}{8}$ inches in diameter. Generally, the diametric expansion of the tube 10 will be limited by the available diameter of the sleeve 18.

Typically, in his/her hands, the user then holds the water filled device. The user may then selectively, from time to time, aim the nozzle 32 and open clamp 38, allowing water to squirt, forwardly from the tip 34 of nozzle 32. Subsequent closure of clamp 38 then stops the outflow of water from the nozzle 32.

iii. Structure. Function and Manufacture of the Nozzle Embodiment Shown in FIGS. 12-16

A second embodiment of applicant's invention comprises a conical squirt head or nozzle for a constant pressure water squirt toy. Such conical squirt head or nozzle is specifically configured and adapted to permit the constant pressure water squirt toy to which it is attached to be filled by various sized water faucets without the need for a separate water faucet adaptor as shown in FIG. 11 above.

In accordance with applicant's invention, there is provided an improved nozzle design as shown in FIGS. 12-16. The presently preferred embodiment in FIGS. 12-16 incorporates a clamping apparatus as an integral part of the nozzle. However, it will be appreciated that the nozzle itself comprises a separate invention and need not be formed as an integral part of the clamping apparatus. Moreover, it will be appreciated that the nozzle and/or nozzle/clamp may be used on any type of constant pressure water toy, including those of the prior art, and is not limited to the constant pressure water toy configured, constructed and manufactured in accordance with the first embodiment of applicant's invention set forth above and shown in FIGS. 1-11.

Referring now to the nozzle embodiment shown in FIGS. 12-16, there is provided a generally frusto conical nozzle or squirt head 70. The preferred embodiment shown also has a clip assembly 72 integrally formed therewith. It will be appreciated, however that the nozzle 70 may be formed separately from the clip and, indeed, various other types of valving apparatus, other than a lip, may be used to control the outflow of water on a squirt toy incorporating the nozzle 70 of this invention.

The nozzle 70 comprises a frusto conical exterior surface 74 with an annular rim 76 formed at the base of the roof. A central aperture 80 is formed at the center of the frontal portion or frustum 78 of the frusto conical nozzle 70.

A tubing insert projection 82 extends rearwardly from the frusto conical nozzle 70. The tip 84 of the tubing insert projection 82 is generally blunt and devoid of sharp edges that may puncture or cut the tubing into which the tubing insert projection 82 is inserted. An axial bore 86 extends longitudinally through the tubing insert projection 82 opening at one end through the tip 84 of projection 82 and at the other end through the central opening 80 of the nozzle 70.

The frusto conical outer configuration of this nozzle permits the squirt toy to be filled with water directly from water faucets of various type, size and configuration without the need for a separate adaptor or filling appliance. For example, as shown in FIG. 16, a standard non-threaded water faucet 90 may be used to fill a water squirt toy incorporating the nozzle 70 of the present invention. As shown, the outer frusto conical portion 74 of the nozzle 70 is partially inserted into the inner bore of the water faucet 90 and is advanced upwardly until the rim of the faucet 90 compresses against the frusto conical outer surface 74 of the nozzle 70 forming a generally liquid tight seal therearound. Hand pressure is used to hold the nozzle 70 in such operative position, maintaining the fluid tight seal around the frusto conical portion 74 of the nozzle 70. The water is turned on and allowed to pass into aperture 80 through axial bore 86 and into the water squirt toy to which the nozzle 70 is attached. After the water squirt toy has been filled, the clip 72 or other valving apparatus is closed off to prevent seepage or release of water and the nozzle 70 is removed from the faucet 90. Thus, the conical or frusto conical nozzle of the present invention may be usable with various types and sizes of faucets without the need for an attendant adaptor or other filling fixture.

In the particular embodiment shown in FIGS. 12-16, the nozzle 70 is further attached to a split-ring mounting assembly with integrally formed clip 72. Such split ring mounting assembly comprises an upper half 92 and a lower half 94. The projection 82 is initially inserted into the lumen **16*a* of the latex tube 10*a*. In the embodiment shown, the outer sleeve 18*a* and tape 24*a* have already been applied in the manner described above with respect to FIGS. 5-8. The upper and lower portions 92, 94 of the split ring assembly are then advanced forwardly so as to exert inward pressure around the distal end of the tubing 10*a*, sleeve 18*a*, and tape 24*a*. Serrated engagement surfaces 96, 98 are formed on the upper and lower portions 92, 94 of the split ring assembly as well as on the inner surface of the annular rim 76 of the nozzle 70. Such serrated engagement surfaces 96, 98 serve to lock and hold the upper and lower portions 92, 94 of the split ring assembly in their operative desired position about the distal end of the device and also serve to maintain an appropriate amount of medially or inwardly directed pressure on the split ring portions 92, 94 so as to hold them in a substantially fixed and locked position. Glue or adhesive may be applied, if necessary, to hold the split ring portions 92, 94 together. Also, various lug and notch tongued grooves or other types of interconnecting or analogous structures may be formed on the upper 92 and lower 94 split ring portions so as to facilitate seating of such split ring portion 94, 96 against one another and rigid maintenance of the operative, assembled configuration shown in FIGS. 12–16. However, the split portions 92, 94 may be designed so that the pressure exerted inwardly thereon by the nozzle 70 is sufficient to hold the portions 92, 94** in substantially solid position without the need for glue or adhesive.

In the embodiment shown, the bottom portion 94 of the split ring assembly is integrally formed as a single piece unit with the body of the clamp 72. The upper portion 92 of the split ring assembly, incorporating the ratchet surface 42*a* is a separate part, which, when assembled as shown in will cooperate and correspond with the remaining portions of the nozzle 70 and clip 72 assembly to firmly mount on the front end of tube 10*a* and to attach, or assist in attaching the front end of outer sleeve 18*a* to the front end of tube 10*a*.

In the embodiment shown, the clamp portion 72 of the nozzle/clamp assembly is similar to the clamp described above with respect to the embodiment shown in FIGS. 1–11. Such clamp 72 is alternately disposable in an "open" configuration and a "closed" configuration. In its "open" configuration (as shown in FIG. 14) the internal projections 40 of the clamp 72 are parted sufficiently so as not to impinge or pinch off the inner lumen 16*a* of the tube 10*a*. When it is desired to close the clamp 72, at least the upper portion of the clamp 72 is pinched or compressed downwardly, causing the internal projections 40*a* to come together, thereby pinching off the inner lumen 16*a* of tube 10*a*. The pawl like head 43*a* of the upper portion of clamp 72 will engage the ratchet surface 42*a* formed on the upper portion 92 of the split ring assembly so as to hold the clamp in such closed configuration until the user wishes to disengage the pawl like head 43*a* from the ratchet surface 42*a*, thereby permitting the clamp 72*a* to return to its "open" configuration. Accordingly, the clamp 72*a* may be used to selectively open/close the lumen 16*a* of the tube 10*a*, thereby permitting selective release of pressurized water through the bore 86 and out of aperture 80.

Figure 17:
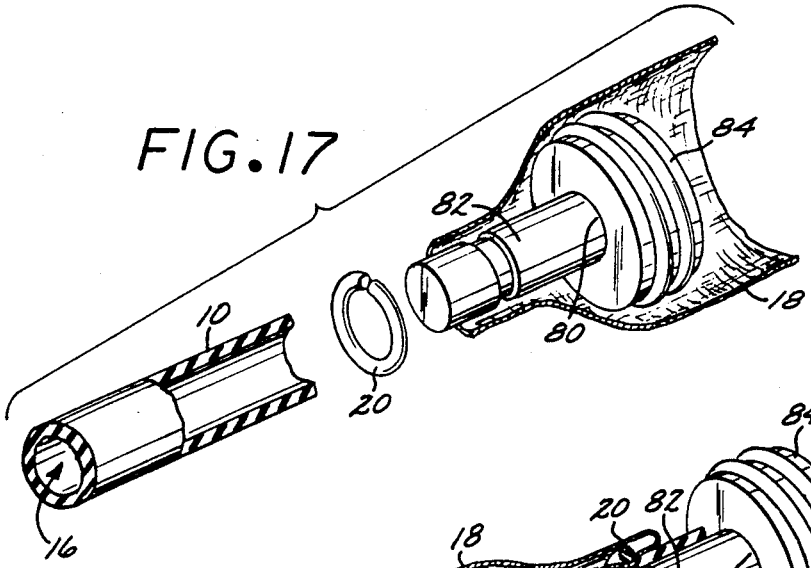
FIG. 17 is an exploded perspective view of a portion of a preferred water squirt device of the present invention including an optional sleeve retaining member, prior to assembly thereof.
Figure 18:
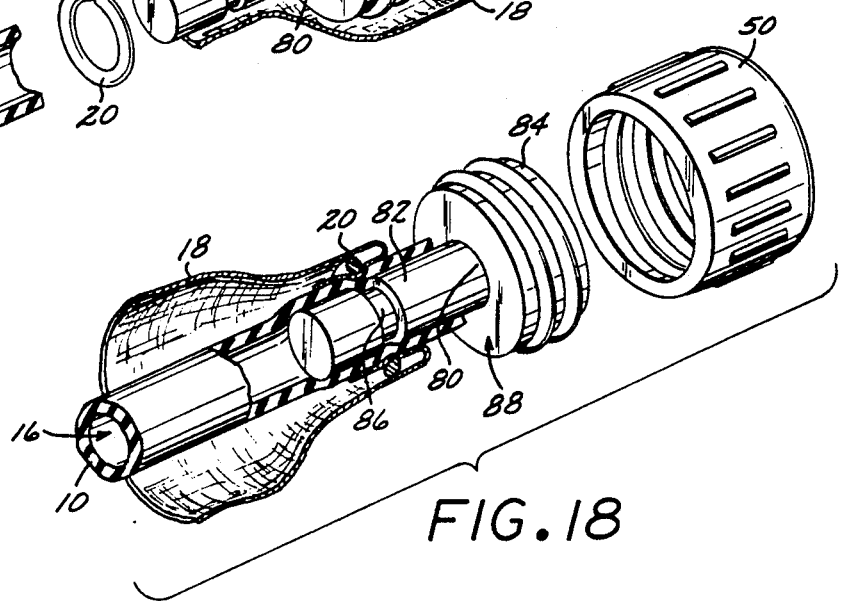
FIG. 18 is a partial perspective view of a preferred water squirt device of the present invention incorporating an optional sleeve retaining member, prior to mounting of the fill-adaptor thereon.
Figure 19:
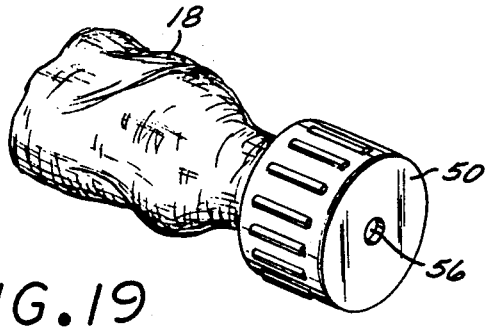
FIG. 19 is a partial perspective view of a preferred water squirt device of the present invention incorporating an optional sleeve retaining member with a preferred fill-adaptor fully mounted thereon.

FIG. 17–19 show an optional sleeve retaining member 80 which optionally may be incorporated into any embodiment of the present invention. Although the sleeve retaining member 80 is shown in FIGS. 17–19 as a round disc-shaped structure, the sleeve retaining member 80 may be of any configuration capable of retaining the sleeve 18 and preventing the slackened sleeve from collecting or passing beyond the sleeve retaining member 80.

The preferred sleeve retaining member 80 in FIGS. 17–19 comprises an elongate portion 82 and a disc-shaped head 84, as shown. The outer surface of the disc-shaped head 84 is optionally threaded to match the inner threads of fill-adaptor 50. Thus, if the head 84 is so threaded, fill-adaptor 50 may be screwed on to the disc-shaped head 84 as shown. Such enables the sleeve retaining member 80 to also function as a fill-adaptor holder to store and retain the fill adaptor 50 in contact with the device during routine operation and use of the device.

As shown in FIGS. 17 18 the sleeve retaining member 80 is initially inserted into the inverted cover 18 as shown in FIG. 17. The elongate portion 82 of the sleeve retaining member 80 is inserted into the end of the lumen 16 of latex tube 10 such that the annular groove 86 formed in the surface of the elongate portion 82 is within the lumen 16 of the tube 10. The clip 20 is then clamped over the sleeve 18 and tube 10 so as to firmly seat within the annular groove 86, thereby holding the sleeve retaining member 80 firmly within the end of latex tube 10 and concomitantly affixing the end of the sleeve 18 thereto.

Thereafter, the sleeve 18 is inverted over the length of the latex tube as shown in FIG. 18. The diameter of the disc portion 84 of the sleeve retaining member 80 is sized relative to the sleeve 18 such that, when the device is empty and the latex tube is in its fully retracted state, the excess or bulk material of the sleeve 18 will lie against the inner face 88 of the disc portion 84 and will not substantially roll or slide beyond the disc portion 84. As such, the disc portion 84 of the sleeve retaining member 80 serves to hold the sleeve 18 in a fluted or puckered state over the length of the latex tube 10, without any substantial portion of the sleeve 18 slipping over the rear end of the device.

The outer surface of the disc portion 84 is threaded, as shown, to receive the fill-adaptor 50 thereon. By such arrangement, the fill-adaptor 50 may be screwed onto the disc portion 84 and held thereon as shown in FIG. 19. Thus, the fill-adaptor 50 is held in connection with the device during routine operation and use and is not easily lost or misplaced.

Although the invention has been described herein with reference to two (2) presently preferred embodiments thereof, it will be appreciated that numerous modifications, additions, and changes may be made to such embodiments, and numerous other embodiments may be conceived, without departing from the spirit and scope of the invention. For example, in the embodiment shown in FIGS. 1–11, various nozzle configurations may be utilized in place of the pen barrel 32 shown in FIGS. 8–10 . Similarly, the particular configuration and type of end clip 20 employed may vary, provided that such clip 20 is capable of performing the function of tightly pinching off the end of the latex tube 10 and/or firmly affixing the outer sleeve 18 to the rear end of the latex tube 10. Thus the end clip 20 is not limited to a "sausage clip" as described herein, although, in this embodiment, a standard "sausage clip" has been found to be fully acceptable for use in accordance with the invention. Also, with respect to the nozzle embodiment shown in FIG. 12–16, it will be appreciated that a simple frusto conical or conical nozzle may be prepared in accordance with the invention. Such nozzle is not required to be connected to the additional split ring and clamp assembly described and shown in FIGS. 12–16. Accordingly, it is intended that these and all other foreseeable changes, modifications, and additions to the above-described embodiments be included within the scope of the following claims and the equivalents thereof.

I claim:

1. A water squirt toy comprising:

an elastic tube having a first end, a second end, and an axial bore extending longitudinally therethrough;

a fluid expulsion nozzle positioned on the first end of the tube to permit squirting of water out of the first end of said tube;

a valving apparatus operative to selectively open and close said nozzle; and an end clip crimped about the second end of said tube to close off the axial bore of said tube at the second end thereof;

a pliable tubular sleeve positioned about said elastic tube, said sleeve being affixed to at least the first and second ends of said elastic tube, the affixation of said sleeve to said second end of said elastic tube being achieved by the positioning of said clip around said sleeve as well as around said tube, thereby causing said end clip, when crimped, to not only seal off the axial bore of said elastic tube but also to firmly affix said sleeve to the second end of said tube.

2. The water squirt toy of claim 1 wherein said nozzle comprises a generally tubular member having an open distal end and an axial bore extending therethrough.

3. The water squirt toy of claim 2 wherein said nozzle comprises a ball point pen barrel.

4. The water squirt toy of claim 1 wherein said valving apparatus comprises a clamp positioned about said tube near the first end thereof and operative to selectively pinch off the inner bore of said tube near the first end thereof so as to selectively prevent outflow of fluid from said tube through said nozzle.

5. The water squirt toy of claim 1 further comprising:

a filling adaptor comprising a cap mountable on a water faucet, said cap having an aperture formed therein, said aperture being specifically sized and 1 configured to accommodate said nozzle for the purpose of filling said water squirt toy through said nozzle.

6. The water squirt toy of claim 1 wherein at least a portion of said nozzle is inserted into the axial bore of said tube at the first end thereof and, further, wherein a quantity of wrapping material is wrapped about the first end of said elastic tube wherein said portion of said nozzle is inserted.

7. The water squirt toy of claim 6 wherein said wrapping material comprises tape.

8. The water squirt toy of claim 7 wherein said wrapping material comprises a quantity of stretchable plastic tape.

9. The water squirt toy of claim 1 wherein said nozzle is at least partially conical in configuration.

10. The water squirt toy of claim 9 wherein the conical portion of said nozzle is sized and configured to be insertable into water faucets of varying size.

11. The water squirt toy of claim 1 further comprising:

a threaded member mounted on the second end of the tube, said threaded member being sized and configured to receive and hold a threaded fill adaptor thereon.

12. The water squirt toy of claim 1 further comprising:

a sleeve retaining member mounted on the second end of said tube, said sleeve retaining member being sized and configured to prevent the material of the sleeve from collecting beyond the second end of said . tube.

13. The water squirt toy of claim 12 wherein said sleeve retaining member is further configured to receive and hold a fill adaptor thereon so as to function as a fill adaptor holder in addition to a sleeve retaining member.

14. The water squirt toy of claim 13 wherein said sleeve retaining member is threaded to receive and hold a threaded fill adaptor thereon.

* * * * *